US005839285A

United States Patent [19]

Kniebes

[11] Patent Number: 5,839,285

[45] Date of Patent: Nov. 24, 1998

[54] FUEL GAS DELIVERY SYSTEM

[76] Inventor: Duane V. Kniebes, 4612 Hampshire St., Boulder, Colo. 80301

[21] Appl. No.: 808,558

[22] Filed: Feb. 28, 1997

[51] Int. Cl.[6] ..... F17C 7/04

[52] U.S. Cl. ..... 62/48.1; 62/50.2

[58] Field of Search ..... 62/48.1, 46.1, 62/50.2

[56] References Cited

U.S. PATENT DOCUMENTS

| | | | |
|---|---|---|---|
| 2,021,394 | 11/1935 | Wade . | |
| 2,651,921 | 9/1953 | Du Rant | 62/46.1 |
| 3,092,972 | 6/1963 | Poorman et al. | 62/46.1 |
| 4,110,995 | 9/1978 | Marchaj | 62/48.1 |

*Primary Examiner*—Ronald Capossela

[57] ABSTRACT

Current self-contained gas delivery systems that provide gas vapor from a liquefied gas source such as odorized liquid propane consist of a single tank, or container. Both liquid and gas are contained in this tank. Fuel gas is supplied to the user from the vapor phase above the liquid. Boil off from the liquid phase to replace the withdrawn vapor phase results in low initial odorant levels, which increase to very high levels as the liquid is used up. This invention corrects this problem by the addition of a second tank or a second compartment within the first tank. The second tank or compartment, which contains gas phase only, is connected to the first compartment containing the liquefied gas by a small-diameter tube immersed in the liquid phase. The second compartment is positioned or valved in such a way that no liquid will accumulate in the compartment. The gas delivery valve to the gas user is located on the second, or vapor-phase-only container. Under static conditions the pressure in both containers will be equal to the vapor pressure of the liquefied gas. Gas flow to the user from the second compartment reduces gas pressure, resulting in vaporization of sufficient liquid from the connecting tubing to once again equalize system pressure. Because of the small diameter tubing, complete vaporization of the liquid and odorant takes place upon entering the second compartment. Thus, the concentration of the odorant in the gas vapor present in the second or vapor phase compartment is equal to that in the liquid. New systems can be constructed or existing systems can easily be modified to achieve this design.

4 Claims, 1 Drawing Sheet

FUEL GAS DELIVERY SYSTEM

BACKGROUND OF THE INVENTION

1. Field of the Invention

This invention relates to a delivery system for the supply of a uniformly odorized fuel gas from a liquefied gas source to users of the vaporized gas.

2. Description of the Prior Art

There are many thousands of self-contained propane supply systems in current use that supply fuel gas to residential and small commercial users. Current practice is to dose the liquid propane prior to delivery with a commercially available odorant and fill pressure containers or tanks on the user's premises to about 85% of their capacity with the liquid. The top portion of the tank not holding the liquid fills with the vapor phase under a pressure equal to the vapor pressure of the liquid at ambient temperature. This pressure is about 100 p.s.i.g. for propane at 60° F. Fuel gas for use in appliances and space heaters is drawn directly from the vapor phase at the top of the tank. The gas is conducted through piping to the point of use after passing through one or two pressure regulators. These regulators reduce the gas pressure to a level acceptable for use by the appliances. This is normally about 11 inches of water column for domestic use. As gas is used from the container, the liquid phase boils off in an amount sufficient to restore the pressure in the vapor in the top of the container. This process continues until the liquid is gone, and the container is then refilled.

Because the liquid boils off to produce the vapor phase, the result is a single plate distillation process. Thus, the low-temperature boiling components of the liquid will become more concentrated in the vapor phase and the higher boiling point components will concentrate in the liquid phase. The ratio of a component's concentration in the vapor phase to that in the liquid phase is called the vapor-liquid equilibrium of that component in the system. This effect is not significant for the fuel gas components in commercially supplied liquid propane, but is very significant for the odorant placed in the propane as a leak-warning agent. The most commonly used odorant in propane is ethyl mercaptan, which has a vapor-liquid equilibrium ratio of 0.2 at 60° F. This means that the ethyl mercaptan concentration in the vapor phase will be about 20% of that in the liquid phase. Current industry practice of mixing 1.5 lbs. of ethyl mercaptan into 10,000 gallons of liquid propane results in about 5 parts per million by volume of the odorant in the vapor phase, and 25 ppm in the liquid phase when the propane is at 60° F. As the vapor is drawn from the tank, the ethyl mercaptan concentration in both vapor and liquid phases increases, still maintaining the 1 to 5 ratio. When about one percent of the liquid remains, the ethyl mercaptan concentration in the vapor phase going to the user is about 250 ppm, a 50 fold increase. Other commercially available odorants have even lower vapor-liquid equilibriums than ethyl mercaptan, and are not used in propane. One exception is tetrahydrothiophene, which is used occasionally at a dose rate of 6.2 lbs. per 10,000 gallons of propane. Low ambient temperatures further reduce the relative concentrations of odorant in the vapor phase.

There are several direct uses of liquid propane such as fuel for vehicles and some industrial burners. There are also a few municipal gas distribution systems that use propane. In these applications liquid propane is vaporized by heat in specially designed heat exchangers for prompt use, and none employ static storage of the vapor.

When liquefied, natural gas is stored an cryogenic temperatures. Odorant in the gas when liquefied does not return to the vapor phase when drawn from the insulated container. Thus, the gas must be odorized again when it comes from the container. This is difficult and expensive to do when the containers are small such as those used to fuel vehicles.

Natural gas distributed to users in distribution piping systems is required by Federal Regulations to have reasonably constant odor levels to enhance consumer safety. Natural gas distribution companies do this, but it cannot be done for propane in self-contained systems with the current technology. A propane and liquefied natural gas delivery system that supplies gas with a constant odor level with any available odorant would have widespread use, and would contribute significantly to the safe use of the gas.

SUMMARY OF THE INVENTION

It is therefore an important object of this invention to provide a self-contained gas supply system for domestic or small commercial use that produces gas, from a liquefied source, whose vapor phase has not established a vapor-liquid equilibrium with the liquid phase.

It is also an object of this invention to provide a gas supply system that produces fuel gas, from a liquefied source, that contains a constant odor level to the end user.

It is also an object of this invention to provide a basic gas system delivery design that can economically be constructed both as a new container and as a modification or retrofit for containers already in service.

It is yet another object of this invention to provide a gas supply system whose vapor phase gas from a liquefied source can be odorized with any commercially available odorant, including mixtures of odorant compounds, and said vapor phase will contain a constant concentration of odorant throughout the full use of the liquefied gas.

The forgoing objects are accomplished by adding a second pressure container of smaller size than that of the first container which holds the liquefied gas. This second, or vapor-phase-only container, is connected to the first container by a tube, or pipe, whose liquid inlet end is positioned at the bottom of the first container so that only liquid phase gas can enter it from the first or liquid phase container. The other end of the connecting tube is connected to the second container at any point, but preferably at or near the bottom. The tube is positioned or valved to prevent any siphoning of liquid into the second or vapor phase container. The size of the tube is such that it will supply sufficient liquefied gas to meet the maximum needs of the end user. A one-quarter inch internal diameter tube will suffice for normal residential users of propane gas. A larger size tube can be used if the liquid surface exposed to the vapor is small enough or a check valve is employed to avoid any significant vapor-liquid equilibrium to be established. The valve that connects to the user's gas supply piping is attached to the second container. Although the system will function properly while the liquid level in the first container remains above the liquid inlet end of the connecting tube, it is appropriate to provide self-acting valves at the inlet and outlet of the connecting tube to maintain full function of the system in the event of complete use of the liquid, or prolonged disuse of the system. To ensure that none of the vapor phase in the first container enters the second container when the liquid level in the first container falls below the entrance to the connecting tube, a float valve of conventional design can be connected to the tube in such a manner as to stop flow of gas or liquid into the tube when the liquid level falls below the entrance to the tube. Alternatively, an orifice can be placed in the connecting tube at a point above the liquid entrance so that approximately 10% of the flow as vapor in the tube to the second container is supplied from the vapor phase in the first container.

Also, to prevent any components of the gas in the second container from flowing back to the first container, a check valve of conventional design can be positioned at the entrance of the tube to the second container. This check valve is designed to dose only when the gas pressure in the second container is approximately 10 psia or less than that in the first container, and will not impede the flow of gas or liquid through the tube to the second container. Thus, return of odorant by diffusion back into the liquid is prevented.

BRIEF DESCRIPTION OF THE DRAWINGS

Two embodiments of the present invention are illustrated in the accompanying drawings wherein.

DETAILED DESCRIPTION OF THE PREFERRED EMBODIMENTS

Figure 1:
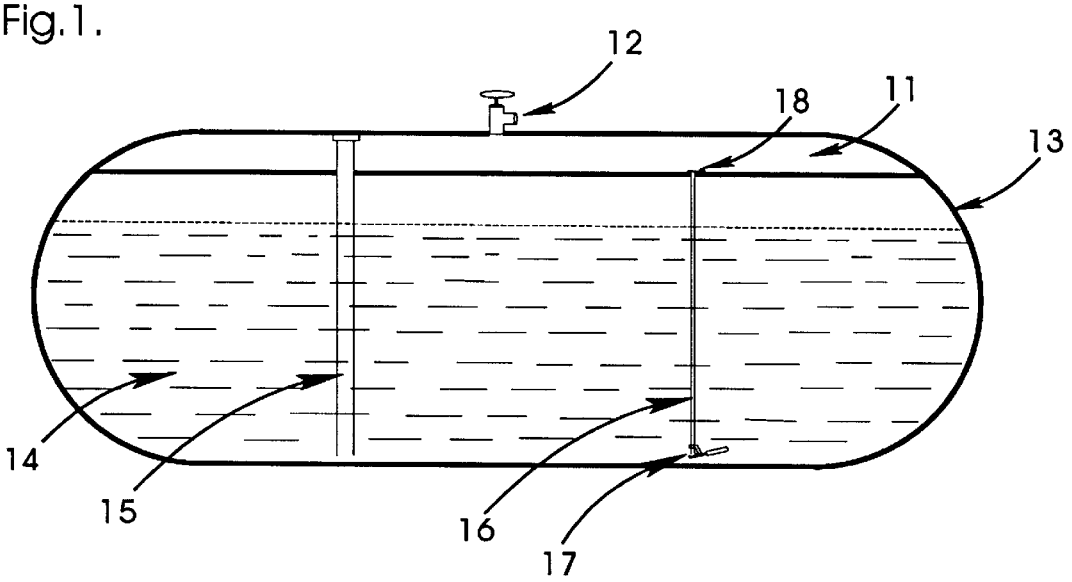
FIG. 1 is a tank of new construction for use to supply propane gas to an end user. It embodies a design described in the present invention.

Referring to FIG. 1, the pressure tank 10 containing liquid propane 14 is constructed with a separate pressure compartment 11. This compartment is connected to the compartment containing the liquid propane by a small diameter tube 16 whose lower opening is located at the bottom of the tank. A float valve 17 is located at the bottom opening of the tube. This valve is of conventional design and is positioned to close the bottom opening of the tube when the liquid level reaches that point. A check valve 18 is located at the top opening of the tube. This valve is of conventional design and allows free flow of liquid or gas into the top compartment 11, but prevents reverse flow of gas or liquid into the lower compartment that contains odorized liquid propane. Also shown are the conventional liquid fill pipe 15 and the service valve 12 to provide gas phase propane to the end user. Not shown are the conventional pressure gage and float gage that shows the percent of liquid in the tank.

When vapor phase propane is withdrawn from the service valve 12 the pressure in the upper compartment 11 is reduced. This causes liquid propane to enter the upper compartment through tube 16 where it completely vaporizes in an amount required to restore the pressure in compartment 11, and prevent further liquid flow. Thus, the vapor in the upper compartment does not remain in contact with liquid propane and no vapor-liquid equilibrium is established. When the liquid level falls below the bottom end of the connecting tube 16, float valve 17 closes so that vapor from the main tank does not enter the upper compartment. Check valve 18 serves to prevent contact of vapor in the upper compartment with liquid in the main tank so that even in the event of prolonged disuse of propane by a user no vapor-liquid equilibrium is established in the upper compartment.

Figure 2:
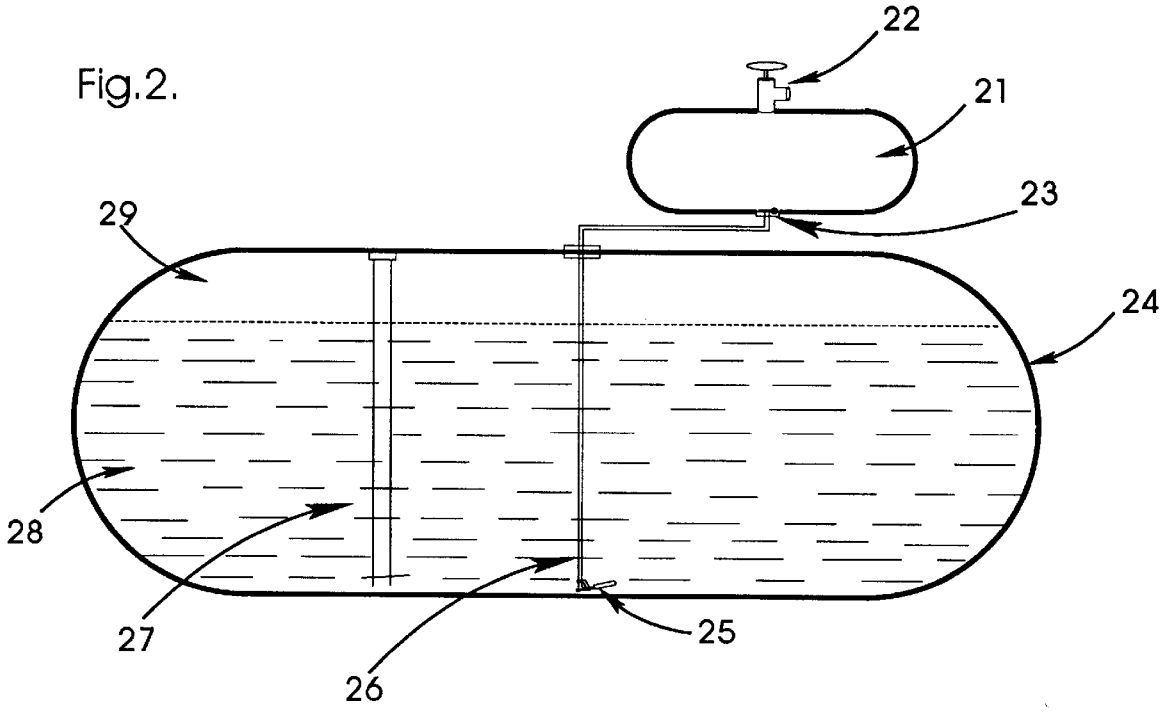
FIG. 2 is a tank typical of that in current use for the supply of propane gas to an end user. It incorporates a modification that can be performed in the field according to the design described in the present invention.

Referring to FIG. 2, a pressure tank 24 of conventional construction containing liquid phase 28 and vapor phase 29 propane is equipped with a liquid fill tube 27. Not shown are conventional pressure and percent-full gages. This type of propane tank is commonly used in commerce for supplying odorized propane gas to domestic and commercial users. The tank shown in FIG. 2 is modified according to the present invention. A separate pressure tank of smaller size 21 is mounted so that the bottom of this smaller tank is above the highest liquid level that occurs in the main tank. The service valve 22 has been removed from the main tank and connected to the smaller tank. A small diameter tube 26 connects the bottom of the smaller tank through a pressure tight seal to the bottom of the main tank where liquid propane can enter. A check valve 23 is located on the tube opening to the smaller tank, and a liquid float valve 25 is located on the tube opening at the bottom of the main tank. These valves function as described under FIG. 1.

The embodiment shown in FIG. 2 functions in the same manner as that shown in FIG. 1. The separate compartment 11 of FIG. 1 is replaced by the external smaller tank 21 of FIG. 2 but functions in the same manner. This embodiment permits existing propane tanks to be modified in the field.

It should be noted that the float valve ( FIG. 1, 17, and FIG. 2, 25 ) is not needed when propane is used from the tank on a regular basis, and liquid propane is added to the tank before the liquid level falls below the opening of the tube at the bottom of the main tank. Further, the float valve is not needed if a small orifice is placed in the connecting tube at a point above the 5% full level of the main tank. The orifice size is such that when the liquid level falls below it, a small amount of vapor from the main tank will enter the connecting tube so that when the liquid phase vaporizes in the smaller tank or compartment the total vapor contains about 10% of the vapor from the main tank. This will produce a moderate variation in the odorant content of the smaller tank or compartment, but will allow total use of the propane placed in the main tank. Extent of the variation will depend upon the orifice size and placement in the connecting tube.

While in the foregoing there has been provided a detailed description of two particular embodiments of the present invention, it is to be understood that all equivalents obvious to those having skill in the art are to be included within the scope of the invention as claimed.

What I claim and desire to secure by letters patent is:

1. A liquid storage and vapor delivery system for odorized liquefied gases comprising in combination; a storage tank for the liquid, connected by a small diameter liquid supply tube to a storage tank for the vapor, said liquid line being separated from the vapor storage tank by a conventional check valve to maintain a lower pressure in the vapor storage tank; and a vapor delivery valve located on the vapor storage tank.

2. A liquid storage and vapor delivery system for odorized liquefied gases comprising in combination; a storage tank for the liquid, connected by a small diameter liquid supply tube to a storage tank for the vapor, said liquid line being separated from the vapor storage tank by a conventional check valve to maintain a lower pressure in the vapor storage tank; and a vapor delivery valve located on the vapor storage tank; said vaporized gas containing a constant concentration of odorant at all times that the gas is withdrawn for use, and at all ambient temperatures.

3. A liquid storage and vapor delivery system for odorized liquefied gases comprising in combination; a storage tank for the liquid, connected by a small diameter liquid supply tube to a storage tank for the vapor, said liquid line being separated from the vapor storage tank by a conventional check valve to maintain a lower pressure in the vapor storage tank; and a vapor delivery valve located on the vaporized gas storage tank; and said vaporized gas can contain any odorant or mixture of odorant compounds commonly used as a warning agent.

4. A liquid storage and vapor delivery system for odorized liquefied gases comprising in combination; a storage tank for the liquid, connected by a small diameter liquid supply tube to a storage tank for the vapor, said liquid line being separated from the vapor storage tank by a conventional check valve to maintain a lower pressure in the vapor storage tank; and a vapor delivery valve located on the vapor storage tank; and said gas supply system can be constructed economically as a new system or as a modification to an existing system.

* * * * *